US008964999B2

(12) United States Patent
Kon

(10) Patent No.: US 8,964,999 B2
(45) Date of Patent: Feb. 24, 2015

(54) AUDIO REPRODUCTION DEVICE AND AUDIO REPRODUCTION METHOD

(75) Inventor: Homare Kon, Tokyo (JP)

(73) Assignee: Sony Corporation, Tokyo (JP)

( * ) Notice: Subject to any disclaimer, the term of this patent is extended or adjusted under 35 U.S.C. 154(b) by 664 days.

(21) Appl. No.: 13/046,268

(22) Filed: Mar. 11, 2011

(65) Prior Publication Data

US 2011/0235808 A1 Sep. 29, 2011

(30) Foreign Application Priority Data

Mar. 29, 2010 (JP) ..... P2010-074490

(51) Int. Cl.
*H04R 29/00* (2006.01)
*H04R 3/00* (2006.01)
*H04R 3/12* (2006.01)

(52) U.S. Cl.
CPC ..... *H04R 3/12* (2013.01)
USPC ..... 381/59; 381/58; 381/96

(58) Field of Classification Search
CPC ..... H04R 3/002; H04R 3/04; H04R 3/12; H04R 27/00; H04R 29/00; H04R 29/001; H04R 29/002; H04R 29/004; H04R 1/2834; H04R 2205/00; H04R 2205/021; H04S 3/00; H04S 7/301; H04S 7/307
USPC ..... 381/1–17, 300–311, 122, 120, 87–91, 381/94.1–94.9, 56–59, 98–103, 77–82, 95, 381/96; 700/94
See application file for complete search history.

(56) References Cited

U.S. PATENT DOCUMENTS

| | | | | |
|---|---|---|---|---|
| 7,697,695 | B2 * | 4/2010 | Sakagami | 381/17 |
| 8,213,621 | B2 * | 7/2012 | Bruno et al. | 381/17 |
| 2010/0272270 | A1 * | 10/2010 | Chaikin et al. | 381/59 |
| 2014/0093108 | A1 * | 4/2014 | Watanabe | 381/303 |

FOREIGN PATENT DOCUMENTS

JP 2008-282042 11/2008

* cited by examiner

*Primary Examiner* — Xu Mei
(74) *Attorney, Agent, or Firm* — Finnegan, Henderson, Farabow, Garrett & Dunner, L.L.P.

(57) ABSTRACT

A method, apparatus, and computer-readable storage medium for processing a sound signal is provided. The method includes receiving first reference data associated with a positional relationship between reference locations on a first device, receiving second reference data associated with a positional relationship between reference locations on a second device, receiving a reference transfer characteristic, wherein the reference transfer characteristic is based on the first and second reference data, determining, by a processor, an actual transfer characteristic based on acoustic data resulting from a test signal, and calculating, by the processor, a correction coefficient based on a difference between the reference transfer characteristic and the actual transfer characteristic.

19 Claims, 7 Drawing Sheets

AUDIO REPRODUCTION DEVICE AND AUDIO REPRODUCTION METHOD

CROSS-REFERENCE TO RELATED APPLICATION

This application claims priority of Japanese Patent Application No. 2010-074490, filed on Mar. 29, 2010, the entire content of which is hereby incorporated by reference.

BACKGROUND

1. Technical Field

The present disclosure relates to an audio reproduction device capable of correcting speaker characteristics in accordance with the model of a speaker unit when the device is connected to the speaker unit having the speaker and an audio reproduction method thereof.

2. Description of the Related Art

In recent years, portable phones having music reproduction capabilities and portable digital music players have been popularized. With this popularization, these portable music players are often connected to a docking speaker so as to reproduce sound. In general, a portable music player has only a small-diameter speaker or even does not have a speaker. However, by connecting the portable music player to a docking speaker which is a relatively large-diameter speaker, it is possible to reproduce audio signals output from the portable music player with high quality or at a high volume.

When sound is reproduced from such a docking speaker, signal processing is performed on the audio signals at the inside of the portable music player, whereby the speaker characteristics can be corrected. The speaker characteristics include frequency characteristics, distortion, transient characteristics, and directional characteristics which depend on the structure of the speaker. If these characteristics of a speaker used as an audio output device are known in advance, they can be corrected by signal processing.

Even when the characteristics of a speaker used as an audio output device are unknown, the characteristics of the speaker can be calculated by collecting sound output from the speaker through a microphone and corrected by signal processing. For example, JP-A-2008-282042 (paragraph [0078], FIG. 7) discloses a "reproduction device" which includes a microphone and corrects the characteristics of a speaker based on a test sound that is output from the speaker and collected by the microphone.

When no object affecting the transfer of sound is present between a microphone and a speaker, it may be possible to correct the speaker characteristics by the technique disclosed in JP-A-2008-282042. However, if an object affecting the transfer of sound is present between the microphone and the speaker, such correction may not be possible. In such a case, when the speaker characteristics are corrected by the technique disclosed in JP-A-2008-282042, it is necessary for a device (hereinafter referred to as a correction device) that performs the correction to acquire the positional relationship between the microphone and the speaker. That is, unless the correction device has the positional relationship, it may be difficult to separate the influence of the speaker characteristics on the sound collected by the microphone and the influence received during propagation of sound waves through a space.

When the characteristics of a docking speaker are corrected by a portable music player, the combination of the docking speaker and the portable music player may come in various configurations. In addition, in a state where a portable music player is mounted on a docking speaker, as a result of this configuration, it is highly likely that an object or the like which affects the transfer of sound is present between the microphone of the portable music player and the speaker of the docking speaker. For this reason, in many cases, it may not be possible to specify the positional relationship between the docking speaker and the microphone provided in the portable music player. Thus, it is difficult to correct the characteristics of the docking speaker using the signal processing of the portable music player.

It is therefore desirable to provide an audio reproduction device and method capable of correcting speaker characteristics in accordance with the model of a speaker unit.

SUMMARY

Accordingly, there is disclosed a method for processing a sound signal. The method may include receiving first reference data associated with a positional relationship between reference locations on a first device; receiving second reference data associated with a positional relationship between reference locations on a second device; receiving a reference transfer characteristic, wherein the reference transfer characteristic is based on the first and second reference data; determining, by a processor, an actual transfer characteristic based on acoustic data resulting from a test signal; and calculating, by the processor, a correction coefficient based on a difference between the reference transfer characteristic and the actual transfer characteristic.

In accordance with an embodiment, there is provided an apparatus having first reference points for processing a sound signal. The apparatus may include a memory device storing instructions; and a processing unit executing the instructions to receive first reference data associated with a positional relationship between the first reference points; receive second reference data associated with a positional relationship between second reference points; receive a reference transfer characteristic, wherein the reference transfer characteristic is based on the first and second reference data; determine an actual transfer characteristic based on acoustic data resulting from a test signal; and calculate a correction coefficient based on a difference between the reference transfer characteristic and the actual transfer characteristic.

In accordance with an embodiment, there is provided a computer-readable storage medium comprising instructions, which when executed on a processor, cause the processor to perform a method for processing a sound signal. The method may include receiving first reference data associated with a positional relationship between reference locations on a first device; receiving second reference data associated with a positional relationship between reference locations on a second device; receiving a reference transfer characteristic, wherein the reference transfer characteristic is based on the first and second reference data; generating a test signal; determining an actual transfer characteristic based on acoustic data resulting from the test signal; and calculating, by the processor, a correction coefficient based on a difference between the reference transfer characteristic and the actual transfer characteristic.

DESCRIPTION OF THE PREFERRED EMBODIMENTS

Hereinafter, an embodiment of the present invention will be described with reference to the drawings.

Schematic Configuration of Audio Reproduction Device and Speaker Dock

Figure 1:
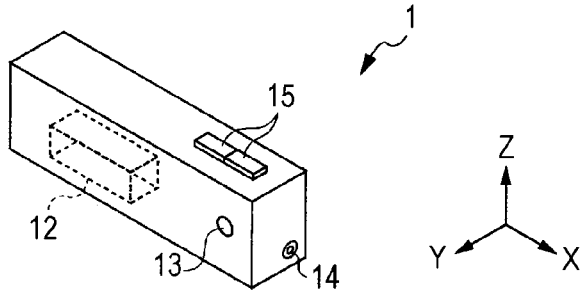
FIG. 1 is a perspective view showing an external view of an audio reproduction device according to an embodiment of the present invention.
Figure 2:
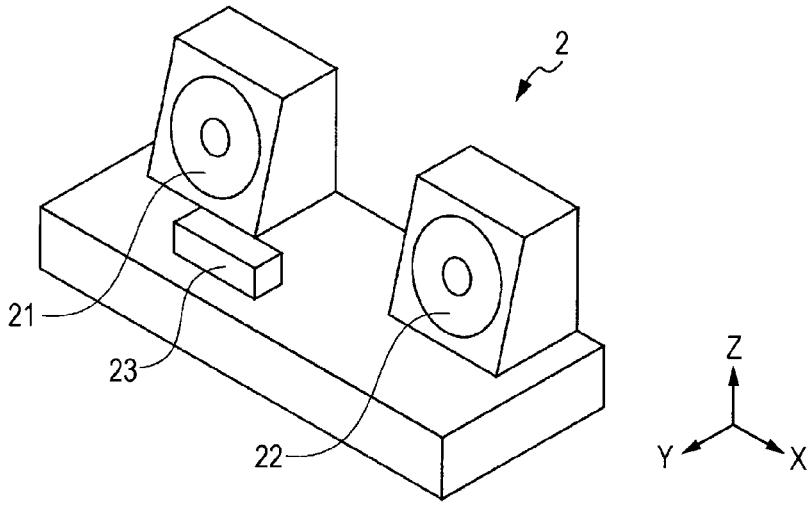
FIG. 2 is a perspective view showing an external view of a speaker dock.
Figure 3:
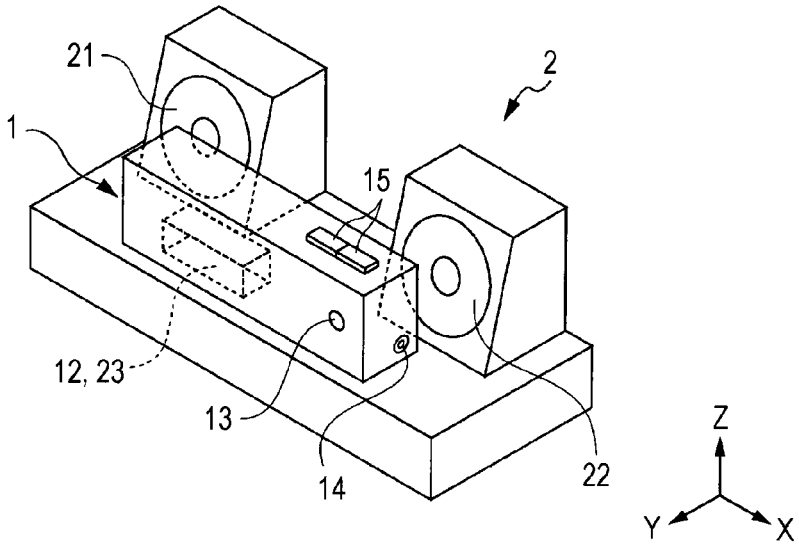
FIG. 3 is a perspective view showing an external view of the audio reproduction device docked to the speaker dock.

FIG. 1 is a perspective view showing an external view of an audio reproduction device 1 according to an embodiment of the present invention, FIG. 2 is a perspective view showing an external view of a speaker dock 2 to which the audio reproduction device 1 is docked, and FIG. 3 is a perspective view showing an external view of the audio reproduction device 1 docked to the speaker dock 2. In these drawings, one direction in a space will be defined as an X direction, and a direction orthogonal to the X direction as a Y direction and a direction orthogonal to the X and Y directions as a Z direction. In the present embodiment, a case where the audio reproduction device 1 is a portable music player will be described as an example.

As shown in FIG. 1, the audio reproduction device 1 has reference locations, such as an engagement recess 12 and a microphone 13. The audio reproduction device 1 is provided with a headphone terminal 14 to which a headphone can be connected and input buttons 15 through which an operation of a user is input. The audio reproduction device 1 is carried by a user and outputs an audio signal stored therein from the headphone terminal 14 in response to a user's operation input through the input buttons 15. The size of the audio reproduction device 1 may be, for example, 10 cm in the X direction, 2 cm in the Y direction, and 3 cm in the Z direction.

The engagement recess 12 is used for mechanical and electrical connection with the speaker dock 2. The engagement recess 12 is formed in a shape capable of engaging with an engagement protrusion 23 of the speaker dock 2. The engagement recess 12 is provided with a connection terminal (not shown) which is electrically connected to the speaker dock 2 when the engagement recess 12 engages with the engagement protrusion 23 of the speaker dock 2. The microphone 13 collects sound output from a speaker of the speaker dock 2. Although the installation position of the microphone 13 is not particularly limited, the microphone 13 is installed at a position such that it is not covered by the speaker dock 2 when the audio reproduction device 1 is docked to the speaker dock 2. The functional configuration of the audio reproduction device 1 will be described later.

As shown in FIG. 2, the speaker dock 2 has reference locations, such as a left speaker 21, a right speaker 22, and the engagement protrusion 23. The left and right speakers 21 and 22 are general speakers and do not have any special configuration. The number of speakers is not limited to 2. The engagement protrusion 23 is formed in a shape capable of engaging with the engagement recess 12 described above and is provided with a connection terminal (not shown) which is electrically connected to the audio reproduction device 1 by the engagement. The size of the speaker dock 2 may be, for example, 14 cm in the X direction, 6 cm in the Y direction, and 9 cm in the Z direction.

In this way, the audio reproduction device 1 and the speaker dock 2 are fixed and electrically connected to each other when the engagement recess 12 engages with the engagement protrusion 23. In the audio reproduction device 1, the audio signal is transmitted to the speaker dock 2 side via the engagement recess 12 and the engagement protrusion 23. In the speaker dock 2, sound corresponding to the audio signal is output from the left and right speakers 21 and 22. At that time, the audio reproduction device 1 performs "correction processing" described later to the audio signal.

Functional Configuration of Audio Reproduction Device

The functional configuration of the audio reproduction device 1 will be described.

Figure 4:
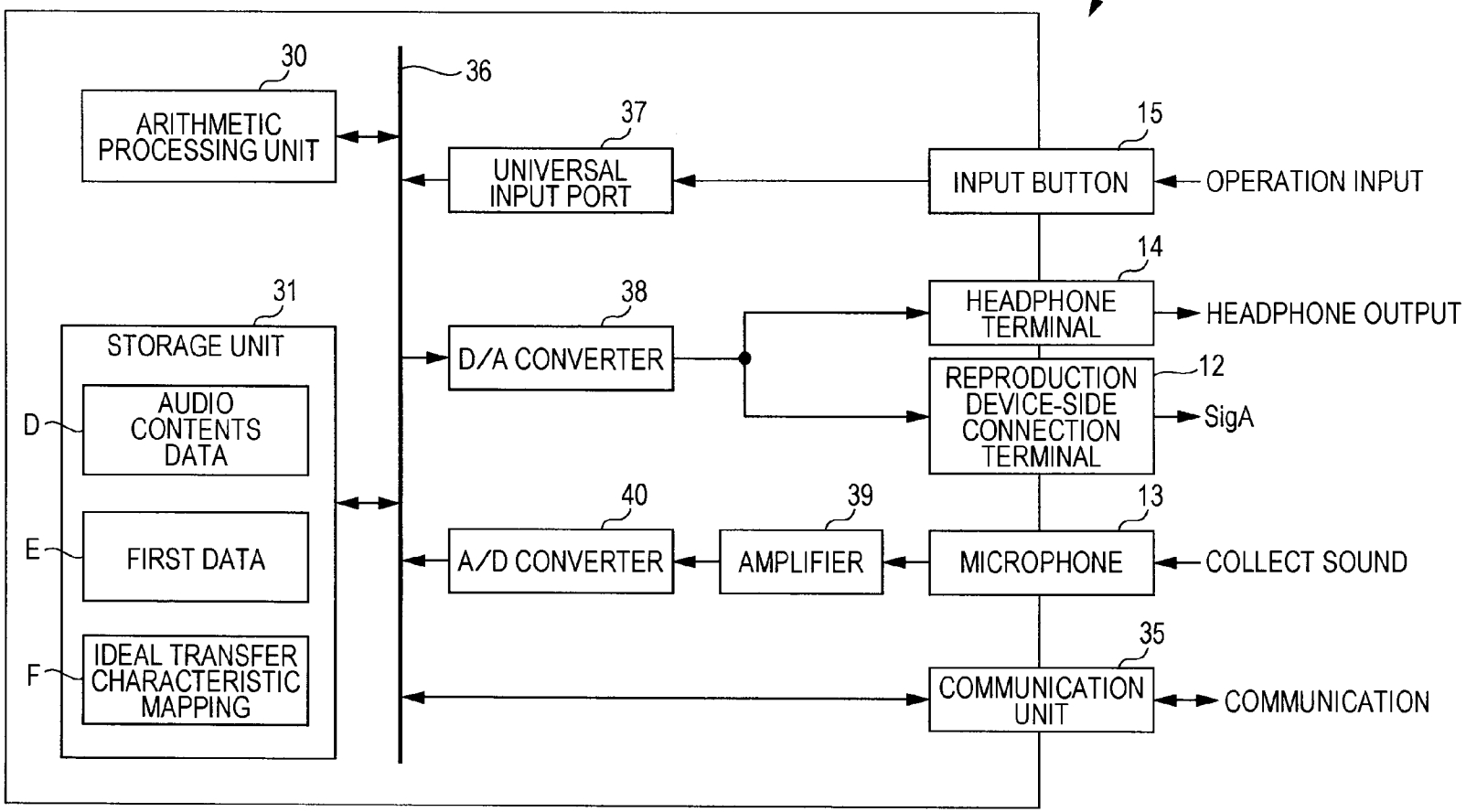
FIG. 4 is a block diagram showing a functional configuration of the audio reproduction device.

FIG. 4 is a block diagram showing a functional configuration of the audio reproduction device 1. As shown in the drawing, the audio reproduction device 1 includes an arithmetic processing unit 30, a storage unit 31, an operation input unit (input buttons 15 and universal port 37), an audio signal output unit (D/A (Digital/Analog) converter 38, headphone terminal 14, and engagement recess 12), an audio signal input unit (microphone 13, amplifier 39, and A/D (Analog/Digital) Converter 40), and a communication unit 35. These components are connected to each other via a bus 36.

The arithmetic processing unit 30 is a device capable of performing arithmetic processing, which is typically a CPU (Central Processing Unit). The arithmetic processing unit 30 acquires an audio signal (contents audio signal) of audio contents from the storage unit 31 via the bus 36, performs correction processing described later on the contents audio signal, and supplies the corrected audio signal to the audio signal output unit via the bus 36.

The storage unit 31 may be a ROM (Read Only Memory), a RAM (Random Access Memory), a HDD (Hard Disk Drive), an SSD (Solid State Drive), or the like, and stores audio contents data D, first data E, ideal transfer characteristics mapping F. The audio contents data D is contents data including at least sound. The first data E and the ideal transfer characteristics mapping F will be described later.

The operation input unit includes the input buttons 15 and the universal input port 37. The input buttons 15 are connected to the bus 36 via a universal input port 37 and supply an operation input signal to the arithmetic processing unit 30 via the universal input port 37 and the bus 36.

The audio signal output unit includes the D/A converter 38, the headphone terminal 14, and the engagement recess 12. The headphone terminal 14 and the engagement recess 12 are connected to the bus 36 via the D/A converter 38. The contents audio signal supplied by the arithmetic processing unit 30 is output to the headphone terminal 14 and the speaker dock 2 side through the D/A converter 38. The contents audio signal output to the speaker dock 2 side will be denoted by an audio signal SigA.

The audio signal input unit includes the microphone 13, the amplifier 39, and the A/D converter 40. The microphone 13 is connected to the bus 36 via the amplifier 39 and the A/D converter 40 and supplies a collected audio signal (sound collection signal) to the arithmetic processing unit 30 via the amplifier 39, the A/D converter 40, and the bus 36.

The communication unit 35 is connected to the bus 36 and performs communication with a network such as the Internet. The communication unit 35 has a connector to which a communication cable is connected, an antenna unit for realizing contactless communication, and the like. The communication unit 35 transfers received information or transmitting information to/from the arithmetic processing unit 30 via the bus 36.

The audio reproduction device 1 is configured in this manner. However, the configuration of the audio reproduction device 1 is not limited to that illustrated herein. For example, a speaker may be provided in the audio reproduction device 1 so that sound can be reproduced without help of any external device. In this case, the audio reproduction device 1 is connected to the speaker dock 2 in order to reproduce sound with higher quality and at higher volume.

Functional Configuration of Speaker Dock

The functional configuration of the speaker dock 2 will be described.

Figure 5:
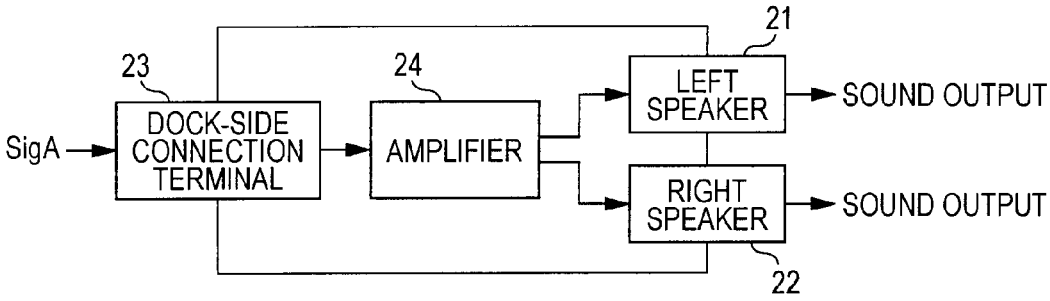
FIG. 5 is a block diagram showing a functional configuration of the speaker dock.

FIG. 5 is a block diagram showing a functional configuration of the speaker dock 2.

As shown in the drawing, the speaker dock 2 includes the engagement protrusion 23, an amplifier 24, and the left and right speakers 21 and 22.

The audio signal SigA supplied from the audio reproduction device 1 side to the speaker dock 2 side through the engagement recess 12 and the engagement protrusion 23 is supplied to the left and right speakers 21 and 22 via the amplifier 24 and output from the left and right speakers 21 and 22 as sound.

Operation of Audio Reproduction Device

The operation of the audio reproduction device 1 will be described.

When the input buttons 15 are operated by a user, the arithmetic processing unit 30 sends a request for an audio contents data D to the storage unit 31 and generates a contents audio signal through expansion arithmetic processing. Here, the arithmetic processing unit 30 outputs an inquiry signal to the connection terminal of the engagement recess 12, for example, and detects whether or not the speaker dock 2 is connected.

When the speaker dock 2 is not detected, the arithmetic processing unit 30 supplies the contents audio signal to the D/A converter 38 via the bus 36. In this case, no correction processing has been performed on the contents audio signal. The D/A converter 38 performs D/A conversion on the contents audio signal and outputs the converted signal to the headphone terminal 14. The contents audio signal is output as sound from a headphone connected to the headphone terminal 14.

When the speaker dock 2 is detected, the arithmetic processing unit 30 performs correction processing described later on the contents audio signal. The arithmetic processing unit 30 supplies the corrected contents audio signal to the D/A converter 38 via the bus 36. The D/A converter 38 performs D/A conversion on the contents audio signal and outputs the converted signal to the speaker dock 2 side through the engagement recess 12. The contents audio signal (SigA) is supplied to the left and right speakers 21 and 22 and output from the speakers as sound.

Correction Processing

The correction processing performed by the audio reproduction device 1 will be described.

For example, when the audio reproduction device 1 is first connected to the speaker dock 2, a "correction coefficient" used for the correction processing is determined. The correction coefficient is determined for a combination of the audio reproduction device 1 and the speaker dock 2. When the audio reproduction device 1 is separated from the speaker dock 2 and is redocked to the speaker dock 2, the determined correction coefficient is used. When the audio reproduction device 1 is connected to another speaker dock different from the speaker dock 2, a correction coefficient is determined for that speaker dock. Determination of the correction coefficient will be described later.

The audio reproduction device 1 performs correction processing on the contents audio signal using the determined correction coefficient. The audio reproduction device 1 can perform the correction processing by the arithmetic processing unit 30 by applying a digital filter such as an FIR (Finite Impulse Response) filter or an IIR (Infinite Impulse Response) filter to the contents audio signal. The correction processing by the digital filter can be expressed as Expression 1 below.

$$y(s)=G(s)\cdot x(s) \qquad \text{Expression 1}$$

In Expression 1, y(s) is the Laplace function of a contents audio signal (output function) output from a digital filter, x(s) is the Laplace function of a contents audio signal (input function) input to the digital filter, and G(s) is the Laplace function of an impulse response function. The G(s) is referred to as the "correction coefficient." Expression 1 implies that the impulse response of the output function for the input function is changed by the correction coefficient.

Next, the determination of the correction coefficient will be described.

Figure 6:
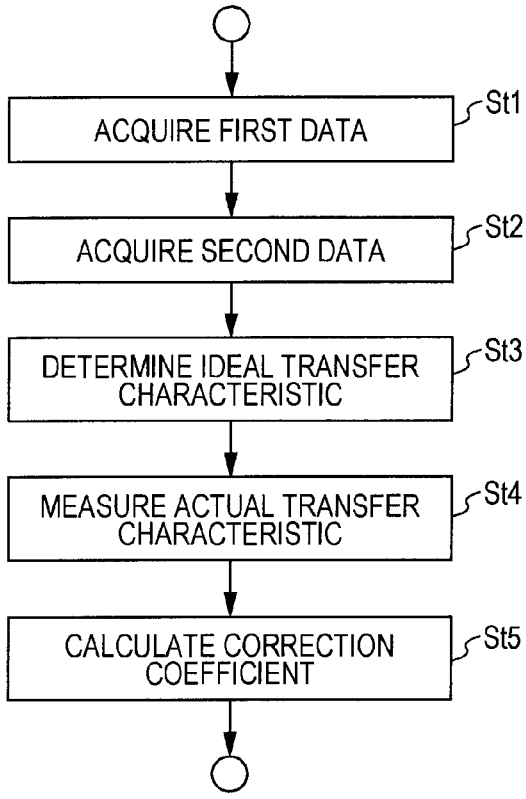
FIG. 6 is a flowchart concerning the determination of a correction coefficient.

FIG. 6 is a flowchart concerning the determination of the correction coefficient. The details of each step will be described below. In the following description, a process of determining the correction coefficient of the left speaker 21 will be described. The same applies to the process of determining the correction coefficient of the right speaker 22.

As shown in FIG. 6, the audio reproduction device 1 acquires first data (St1) (i.e., first reference data). The first data is data that specifies the position and orientation of the microphone 13 (i.e., input device) with respect to the engagement recess 12 (i.e., device receiving part). Subsequently, the audio reproduction device 1 acquires second data (St2) (i.e., second reference data). The second data is data that specifies the position and orientation of a sound producing device (in this example, the left speaker 21) with respect to the engagement protrusion 23 (i.e., device receiving part). Subsequently, from the first and second data acquired in steps St1 and St2, the audio reproduction device 1 determines "ideal transfer characteristics" (i.e., reference transfer characteristic) in the position and orientation (hereinafter referred to as positional relationships) specified by these data (St3). The ideal transfer characteristics are transfer characteristics that are to be measured in the positional relationships when the speaker characteristics are corrected ideally.

Subsequently, the audio reproduction device 1 measures the transfer characteristics (actual transfer characteristics) of the left speaker 21 in these positional relationships (St4). The transfer characteristics are the ratio of the signal (sound collection signal i.e., acoustic data result) of the sound collected by the microphone 13 to a test sound signal output to the left speaker 21. Subsequently, the audio reproduction device 1 calculates a correction coefficient for making the actual transfer characteristics identical to the ideal transfer characteristics (St5).

Hereinafter, the details of each step will be described.

The first data acquisition step (St1) will be described.

Figure 7A:
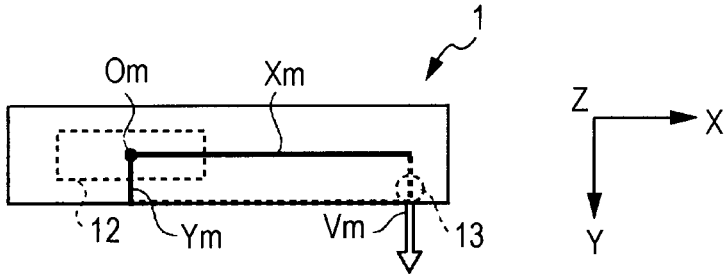
FIGS. 7A to 7C are plan views of the audio reproduction device.
Figure 7B:
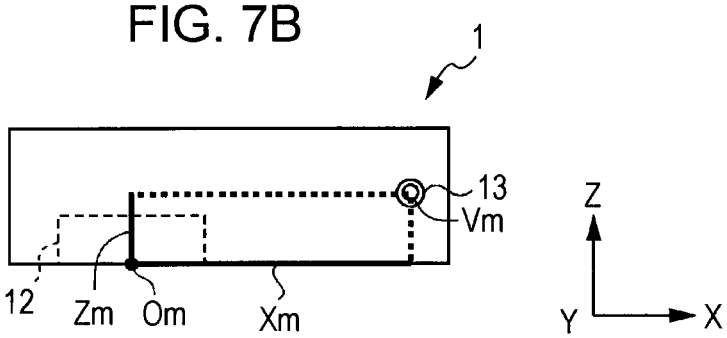
Figure 7C:
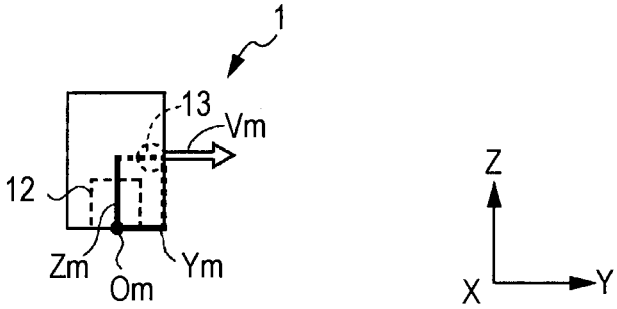

FIGS. 7A to 7C are plan views of the audio reproduction device 1. FIG. 7A is a top view seen from the Z direction, FIG.

7B is a front view seen from the Y direction, and FIG. 7C is a side view seen from the X direction. As shown in these drawings, the positional coordinate (hereinafter Pm) of the microphone 13 is the coordinate of the microphone 13 when the origin Om is at one point of the engagement recess 12. In FIGS. 7A to 7C, the positional coordinate Pm of the microphone 13 is illustrated as Xm, Ym, and Zm for the X, Y, and Z coordinates, respectively. The orientation (sound collection direction) of the microphone 13 can be expressed as a directional vector. In FIGS. 7A to 7C, the directional vector of the microphone 13 is denoted as Vm.

In the present embodiment, since the first data E is stored in the storage unit 31, the arithmetic processing unit 30 acquires the first data E from the storage unit 31. When the first data is not stored in the storage unit 31, the arithmetic processing unit 30 may acquire the first data from a network via the communication unit 35. Moreover, the arithmetic processing unit 30 may acquired the first data which is input directly by a user through the input buttons 15. In this way, the first data is acquired by the arithmetic processing unit 30.

The second data acquisition step (St2) will be described.

Figure 8A:
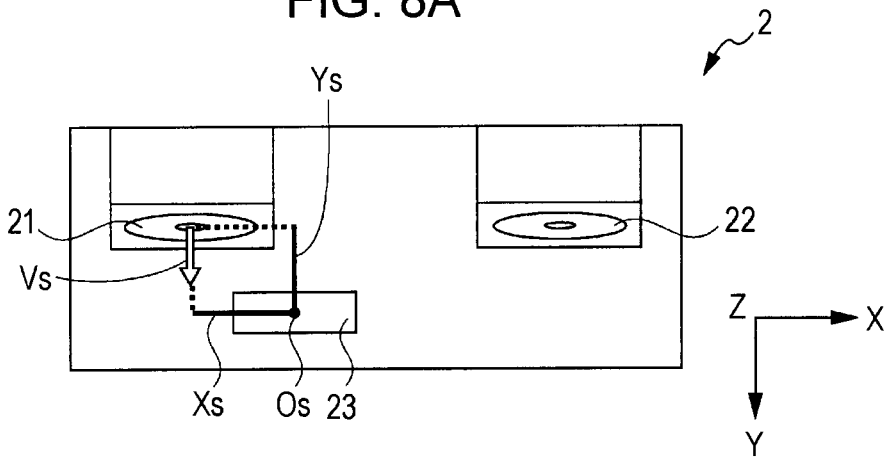
FIGS. 8A to 8C are plan views of the speaker dock.
Figure 8B:
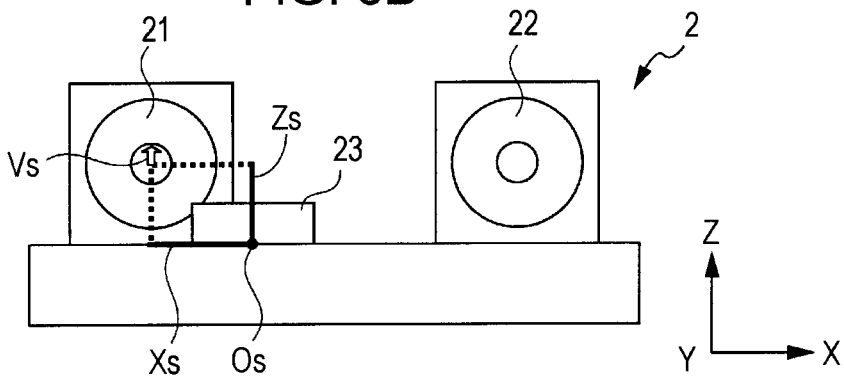
Figure 8C:
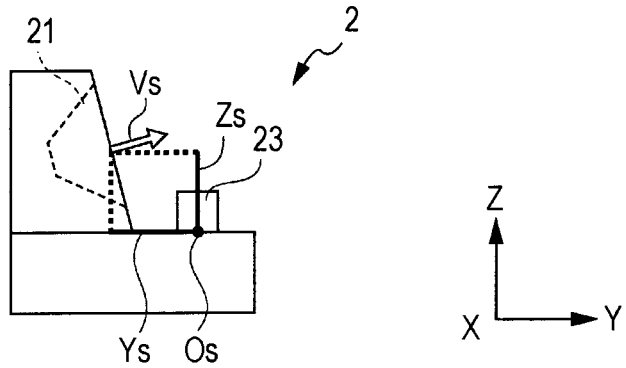

FIGS. 8A to 8C are plan views of the speaker dock 2. FIG. 8A is a top view seen from the Z direction, FIG. 8B is a front view seen from the Y direction, and FIG. 8C is a side view seen from the X direction. As shown in these drawings, the positional coordinate (hereinafter Ps) of the left speaker 21 is the coordinate of the left speaker 21 when the origin Os is at one point of the engagement protrusion 23. Here, it is assumed that the origin Os is identical to the origin Om when the engagement protrusion 23 is connected to the engagement recess 12. In FIGS. 8A to 8C, the positional coordinate Ps of the left speaker 21 is illustrated as Xs, Ys, and Zs for the X, Y, and Z coordinates, respectively. The orientation (sound output direction) of the left speaker 21 can be expressed as a directional vector. In FIGS. 8A to 8C, the directional vector of the left speaker 21 is denoted as Vs.

The second data for the speaker docks of various models (types) can be stored in advance in the storage unit 31. In this case, the arithmetic processing unit 30 is able to acquire the second data of a speaker dock of the same model from the storage unit 31 by referring to "model information" of the speaker dock 2 input by a user through the input buttons 15. The model information is information that can specify the model of a speaker dock, and for example, a model number of the speaker dock may be used. Moreover, the arithmetic processing unit 30 may acquire the second data of a speaker dock of the corresponding model from a network via the communication unit 35 based on input model information. In addition to this, for example, when a camera, a barcode reader, or the like is mounted on the audio reproduction device 1, and a barcode, a QR code (registered trademark), or the like is printed on the speaker dock 2, the arithmetic processing unit 30 may acquire the second data from the storage unit 31 by referring to model information obtained from the QR code or the like with the camera or the like.

When the second data is not stored in the storage unit 31, the arithmetic processing unit 30 may acquire the second data of the speaker dock 2 from a network via the communication unit 35. Moreover, the arithmetic processing unit 30 may acquire the second data that is directly input by a user through the input buttons 15. In this way, the second data is acquired by the arithmetic processing unit 30.

The order of the first data acquisition step (St1) and the second data acquisition step (St2) may be reversed.

The ideal transfer characteristics determination step (St3) will be described.

The arithmetic processing unit 30 determines ideal transfer characteristics $Hi_{(Pm, Vm, Ps, Vs)}$ from the positional coordinate Pm and directional vector Vm of the microphone 13 obtained in step St1 and the positional coordinate Ps and directional vector Vs of the left speaker 21 obtained in step St2. The ideal transfer characteristics $Hi_{(Pm, Vm, Ps, Vs)}$ are transfer characteristics that are to be measured in the positional relationship (Pm, Vm, Ps, Vs) when the speaker characteristics are corrected ideally. The ideal speaker characteristics may be flat frequency characteristics, linear phase characteristics, minimal phase characteristics, and the like.

Figure 9A:
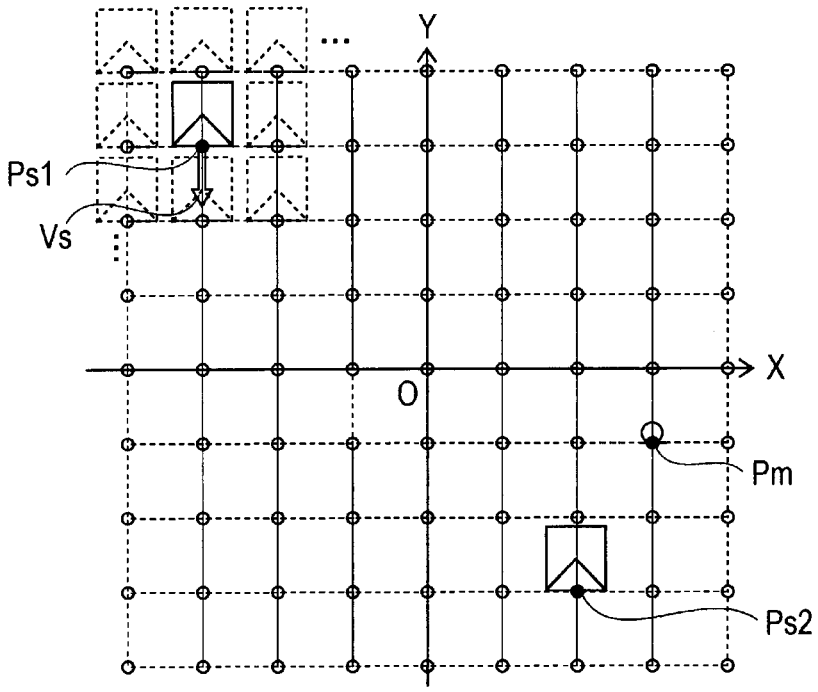
FIGS. 9A and 9B are conceptual diagrams showing ideal transfer characteristics mapping.
Figure 9B:
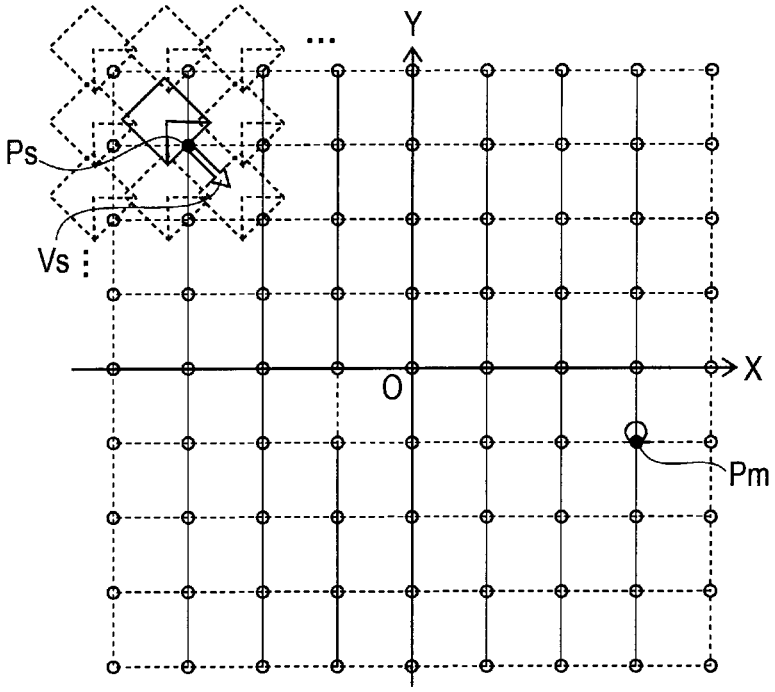

The arithmetic processing unit 30 is able to determine the ideal transfer characteristics $Hi_{(Pm, Vm, Ps, Vs)}$ using an "ideal transfer characteristics mapping." As described above, the ideal transfer characteristics mapping F is stored in the storage unit 31. FIGS. 9A and 9B are conceptual diagrams showing the ideal transfer characteristics mapping. In FIGS. 9A and 9B, the directional vectors Vs of the left speaker 21 are different. Illustration for the Z-axis direction is omitted in FIGS. 9A and 9B. The ideal transfer characteristics mapping is one that maps ideal transfer characteristics candidates in each grid of the positional coordinate with respect to the origin (Os) of a speaker (in this example, the left speaker 21) for each positional coordinate Pm and directional vector Vm of the microphone 13. For example, the ideal transfer characteristics candidates are measured in advance using a speaker having ideal speaker characteristics. For example, as shown in FIGS. 9A and 9B, when the positional coordinate Pm of the microphone 13 is (Xm, Ym)=(3, −1) and the directional vector Vm is parallel to the Y axis, the corresponding mapping is requested. Here, in addition, the corresponding mapping is selected in accordance with the directional vector Vs of the left speaker 21. The values ((3, −1) or the like) of the coordinates are arbitrary, and the unit thereof is cm, for example.

FIG. 9A shows an example of the mapping when the directional vector Vs of the left speaker 21 is parallel to the Y axis, and FIG. 9B shows an example of the mapping when the directional vector Vs is oblique to the Y axis. In the respective mappings, for example, when the positional coordinate Ps is (Xs, Ys)=(−3, 3), the ideal transfer characteristics candidates that can be assigned to the grid are determined as the ideal transfer characteristics $Hi_{(Pm, Vm, Ps, Vs)}$.

Figure 10A:
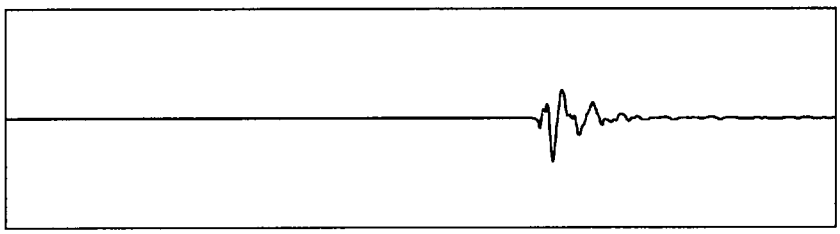
FIGS. 10A and 10B are diagrams showing examples of ideal transfer characteristics candidates.
Figure 10B:
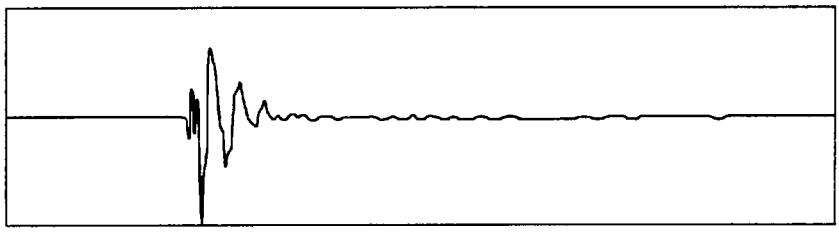

FIGS. 10A and 10B show the difference in the ideal transfer characteristics when the positional coordinates Ps of the left speaker 21 are different in the mapping shown in FIG. 9A. FIG. 10A shows the ideal transfer characteristics $Hi_{(Pm, Vm, Ps, Vs)}$ when the positional coordinate Ps1 is (Xs, Ys)=(−3, 3), and FIG. 10B shows the ideal transfer characteristics $Hi_{(Pm, Vm, Ps, Vs)}$ when the positional coordinate Ps2 is (Xs, Ys)=(2, −3).

When the audio reproduction device 1 does not use the ideal transfer characteristics mapping but determines the ideal transfer characteristics $Hi_{(Pm, Vm, Ps, Vs)}$ from the first and second data, it is difficult to calculate the linear characteristics due to the effect of diffraction or the like due to a housing of the audio reproduction device 1. The arithmetic processing unit 30 can determine the ideal transfer characteristics $Hi_{(Pm, Vm, Ps, Vs)}$ by selecting one where the first and second data are close to each other, from the ideal transfer characteristics candidates which are mapped in advance.

In the example above, although a case where the positional coordinate Ps is positioned on the grid, a case where the positional coordinate Ps is not positioned on the grid may be considered. In that case, an ideal transfer characteristics candidate of a grid that is closest to the Ps can be determined as the ideal transfer characteristics $Hi_{(Pm, Vm, Ps, Vs)}$. Moreover, the ideal transfer characteristics may be approximated from the ideal transfer characteristics candidates of adjacent grids.

Figure 11:
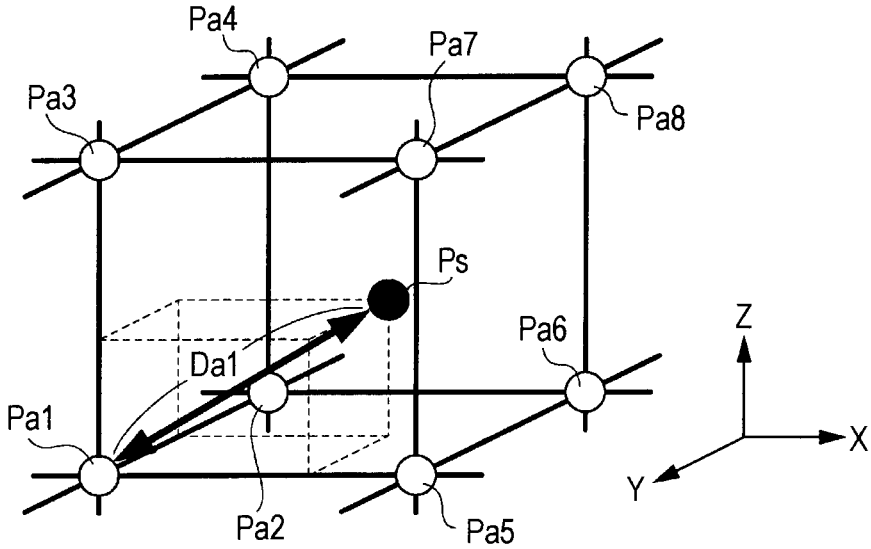
FIG. 11 is a conceptual diagram showing a method of approximating ideal transfer characteristics.

FIG. 11 is a conceptual diagram showing a method of approximating the ideal transfer characteristics $Hi_{(Pm,\ Vm,\ Ps,\ Vs)}$.

For example, as shown in the drawing, when the positional coordinate Ps is positioned between grids Pal to Pa8 (PaN), the distances between the positional coordinate Ps and the respective grids PaN are Da1 to Da8 (DaN), and the ideal transfer characteristics candidates of the respective grids PaN are Hal to Ha8 (HaN), the determined ideal transfer characteristics $Hi_{(Pm,\ Vm,\ Ps,\ Vs)}$ can be represented by Formula 1 below. In Formula 1, Dsum is the sum of Da1 to Da8.

$$Hi_{(Pm,Vm,Ps,Vs)} = \sum_{n=1}^{8} Han \cdot \left(1 - \frac{Dan}{Dsum}\right) \quad \text{[Formula 1]}$$

Such an approximation is effective particularly when the size of the audio reproduction device 1 and the left speaker 21 is relatively small, and a change in the transfer characteristics with respect to distance is large. Moreover, when the mappings are created in advance, it is possible to increase the distance between the grids and suppress the number of measurement points. In this way, the ideal transfer characteristics $Hi_{(Pm,\ Vm,\ Ps,\ Vs)}$ in the positional relationship (Pm, Vm, Ps, Vs) are determined.

The actual transfer characteristics measurement step (St4) will be described.

The arithmetic processing unit 30 outputs a test sound signal from the engagement recess 12. As for the test sound signal, a TSP (Time Stretched Pulse) signal, an M-series signal, white noise, and the like can be used. The test sound signal arrives at the left speaker 21 through the engagement protrusion 23 and is output from the left speaker 21.

The microphone 13 collects the sound (test sound) output from the left speaker 21 and supplies the sound to the arithmetic processing unit 30 as a sound collection signal. The arithmetic processing unit 30 compares the test sound signal and the sound collection signal to determine actual transfer characteristics H(s). The actual transfer characteristic H(s) can be expressed as Expression 2 below.

$$Y(s)=H(s)\cdot X(s) \quad \text{Expression 2}$$

In Expression 2, Y(s) is the Laplace function of the sound collection signal (output function), and X(s) is the Laplace function of the test sound signal (input function). That is, the actual transfer characteristics H(s) represent a change in the impulse response of the sound collection signal with respect to the test sound signal. The arithmetic processing unit 30 is able to calculate the actual transfer characteristics H(s) by eliminating Y(s) with X(s) as shown in Expression 2. The calculated actual transfer characteristics H(s) include the speaker characteristics of the left speaker 21 and the spatial transfer characteristics (a change in the impulse response received during propagation of sound waves through a space) between the left speaker 21 and the microphone 13.

The correction coefficient calculation step (St5) will be described.

As described above, the ideal transfer characteristics $Hi_{(Pm,\ Vm,\ Ps,\ Vs)}$ obtained in step St3 are the transfer characteristics that are to be measured in the positional relationship (Pm, Vm, Ps, Vs) when sound was output from a speaker having the ideal speaker characteristics. Therefore, an ideal system can be expressed as Expression 3 below using the ideal transfer characteristics $Hi_{(Pm,\ Vm,\ Ps,\ Vs)}$.

$$Y(s)=Hi_{(Pm,Vm,Ps,Vs)}\cdot X(S) \quad \text{Expression 3}$$

Here, as shown in Expression 1, when the test sound signal X(s) is subjected to correction processing by a digital filter, the relationship between the test sound signal X(s) and the sound collection signal Y(s) can be expressed as Expression 4 below.

$$Y(s)=H(s)\cdot G(s)\cdot X(s) \quad \text{Expression 4}$$

When Expression 3 is identical to Expression 4, it is possible to correct the speaker characteristics of the left speaker 21 to the ideal speaker characteristics using the correction coefficient G(s). Therefore, the correction coefficient G(s) can be determined as Expression 5 below using the ideal transfer characteristics $Hi_{(Pm,\ Vm,\ Ps,\ Vs)}$ in the positional relationship (Pm, Vm, Ps, Vs) determined in step St3 and the actual transfer characteristics H(s) measured in step St4.

$$G(s)=Hi_{(Pm,Vm,Ps,Vs)}/H(s) \quad \text{Expression 5}$$

The audio reproduction device 1 determines the correction coefficient G(s) in this way.

The audio reproduction device 1 determines the correction coefficient of the right speaker 22 in a similar manner. In this case, since the first data is the same as in the case of the left speaker 21, the first data acquisition step (St1) can be omitted. Upon receiving a contents reproduction instruction from a user through the input buttons 15, the audio reproduction device 1 performs correction processing on the contents audio signal using the correction coefficients for the left and right speakers 21 and 22 thus obtained and the left and right speakers 21 and 22 output the corrected contents audio signal. Since the correction coefficient of each speaker is determined based on the ideal speaker characteristics, the audio reproduction device 1 is able to perform correction processing on the contents audio signal so that the respective speaker characteristics are corrected to the ideal speaker characteristics.

If the audio reproduction device 1 is connected to a speaker dock of which the model, namely the second data, is different from the speaker dock 2, the correction coefficient of each speaker is determined and used for the correction processing in the above-described manner. The audio reproduction device 1 stores the correction coefficient of each speaker thus obtained in the storage unit 31 or the like, whereby the same correction coefficient can be used when connected to a speaker dock of the same model.

Given the above, according to the present embodiment, the arithmetic processing unit 30 performs correction processing on the contents audio signal based on the first and second data, whereby a component corresponding to the spatial transfer characteristics can be eliminated from the actual transfer characteristics H(s), and the characteristics of the speaker can be corrected in accordance with the model of the speaker dock.

The ideal transfer characteristics $Hi_{(Pm,\ Vm,\ Ps,\ Vs)}$ determined from the first and second data include the speaker characteristics of an ideal speaker and the spatial transfer characteristics in the positional relationship. For this reason, the correction coefficient G(s) for converting the actual transfer characteristics H(s) to the ideal transfer characteristics $Hi_{(Pm,\ Vm,\ Ps,\ Vs)}$ can be regarded as the correction coefficient for converting the speaker characteristics of the speaker dock 2 to the ideal speaker characteristics. Therefore, by applying the correction coefficient G(s) to the contents audio signal, it is possible to correct the speaker characteristics in accordance with the model of the speaker dock.

The present invention is not limited to the embodiment described above but may be changed within a range without departing from the spirit of the present invention.

In the embodiment described above, although the correction coefficient was determined by the arithmetic processing unit, the present invention is not limited to this. The audio reproduction device may transmit the first and second data and the actual transfer characteristics to the network using the communication unit so that the ideal transfer characteristics are determined on the network and receive the correction coefficient.

In the embodiment described above, although the audio reproduction device acquired the second data using the model information of the speaker dock, the present invention is not limited to this. The audio reproduction device may acquire the correction coefficient from the storage unit or the network using the model information of the speaker dock, for example.

In the embodiment described above, although the first and second data were described as data specifying the position and orientation with respect to the connection terminal, the present invention is not limited to this. For example, the first and second data may be data specifying only the position with respect to the connection terminal.

It should be understood by those skilled in the art that various modifications, combinations, sub-combinations and alterations may occur depending on design requirements and other factors insofar as they are within the scope of the appended claims or the equivalents thereof.

The overview and specific descriptions of the above-described embodiment and the other embodiments are examples. The present invention may also be applied and can be applied to various other embodiments. It should be understood by those skilled in the art that various modifications, combinations, sub-combinations and alterations may occur depending on design requirements and other factors insofar as they are within the scope of the appended claims or the equivalents thereof.

What is claimed is:

1. A computer-implemented method for processing a sound signal, comprising:

receiving first reference data associated with a positional relationship between reference locations on a first device;

receiving second reference data associated with a positional relationship between reference locations on a second device;

receiving a reference transfer characteristic, wherein the reference transfer characteristic is based on the first and second reference data, and wherein the reference transfer characteristic is calculated from pre-determined reference transfer characteristic candidates corresponding to pre-determined positional relationships adjacent to the positional relationships with which the first reference data and second reference data are associated;

determining, by a processor, an actual transfer characteristic based on acoustic data resulting from a test signal;

calculating, by the processor, a correction coefficient based on a difference between the reference transfer characteristic and the actual transfer characteristic; and processing the sound signal based on the correction coefficient.

2. The method of claim 1, wherein receiving the reference transfer characteristic comprises receiving the reference transfer characteristic in response to a determination by the first device based on the first and second reference data.

3. The method of claim 1, wherein receiving the reference transfer characteristic comprises receiving the reference transfer characteristic in response to a determination by the second device based on the first and second reference data.

4. The method of claim 1, wherein the first reference data and the second reference data correspond to predetermined data stored in a memory device.

5. The method of claim 1, wherein receiving the first reference data and the second reference data comprises receiving at least one of the first reference data or the second reference data from a network.

6. The method of claim 1, wherein the reference locations on the first device include a first location corresponding to an input device and a second location corresponding to a device receiving part.

7. The method of claim 1, wherein the reference locations on the second device include a first location corresponding to a sound producing device and a second location corresponding to a device receiving part.

8. The method of claim 1, wherein the first device is a mobile phone, a music player, a handheld computer, a navigation system, or a personal digital assistant.

9. The method of claim 8, wherein one of the reference locations on the first device corresponds to a location of a microphone, and the first device uses the microphone to perform one or more functions.

10. The method of claim 1, wherein processing the sound signal based on the correction coefficient comprises applying a digital filter.

11. The method of claim 1, further comprising:

receiving identification information corresponding to the second device, wherein:

the request includes the identification information; and receiving the second reference data comprises receiving the second reference data in response to the request.

12. The method of claim 1, wherein the first reference data includes:

a spatial coordinate; and a directional vector associated with the reference locations on the first device.

13. The method of claim 1, wherein the second reference data includes a directional vector associated with the reference locations on the second device.

14. An apparatus having first reference points for processing a sound signal, comprising:

a memory device storing instructions; and a processing unit executing the instructions to:

receive first reference data associated with a positional relationship between the first reference points;

receive second reference data associated with a positional relationship between second reference points;

receive a reference transfer characteristic, wherein the reference transfer characteristic is based on the first and second reference data, and wherein the reference transfer characteristic is calculated from pre-determined reference transfer characteristic candidates corresponding to pre-determined positional relationships adjacent to the positional relationships with which the first reference data and second reference data are associated;

determine an actual transfer characteristic based on an acoustic data result from a test signal; and calculate a correction coefficient based on a difference between the reference transfer characteristic and the actual transfer characteristic.

15. The apparatus of claim 14, wherein the processing unit executes the instructions to process a sound signal based on the correction coefficient.

16. The apparatus of claim 14, further comprising a communication unit for sending a request over a network, wherein processing unit receives the second reference data in response to the request.

17. The apparatus of claim 14, wherein the memory device stores the first reference data and the second reference data as predetermined data.

18. The apparatus of claim 14, wherein the first reference data includes:

a spatial coordinate; and a directional vector associated with the reference locations on the first device.

19. A computer-readable storage medium comprising instructions, which when executed on a processor, cause the processor to perform a method for processing a sound signal, the method comprising:

receiving first reference data associated with a positional relationship between reference locations on a first device;

receiving second reference data associated with a positional relationship between reference locations on a second device;

receiving a reference transfer characteristic, wherein the reference transfer characteristic is based on the first and second reference data, and wherein the reference transfer characteristic is calculated from pre-determined reference transfer characteristic candidates corresponding to pre-determined positional relationships adjacent to the positional relationships with which the first reference data and second reference data are associated;

generating a test signal;

determining an actual transfer characteristic based on acoustic data resulting from the test signal;

calculating, by the processor, a correction coefficient based on a difference between the reference transfer characteristic and the actual transfer characteristic; and processing the sound signal based on the correction coefficient.

* * * * *